US010982482B2

(12) United States Patent
Gruber et al.

(10) Patent No.: US 10,982,482 B2
(45) Date of Patent: Apr. 20, 2021

(54) VEHICLE DOOR SYSTEM WITH POWER DRIVE MODULE

(71) Applicant: Multimatic Inc., Markham (CA)

(72) Inventors: Rudolf Gruber, Uxbridge (CA); Andrew R. Daniels, Sharon (CA); Balathas Nagamany, Markham (CA)

(73) Assignee: Multimatic Inc., Markham (CA)

( * ) Notice: Subject to any disclaimer, the term of this patent is extended or adjusted under 35 U.S.C. 154(b) by 0 days.

(21) Appl. No.: 16/718,605

(22) Filed: Dec. 18, 2019

(65) Prior Publication Data

US 2020/0123836 A1 Apr. 23, 2020

Related U.S. Application Data

(62) Division of application No. 15/533,472, filed as application No. PCT/US2015/025074 on Apr. 9, 2015, now Pat. No. 10,590,691.

(51) Int. Cl.

| | |
|---|---|
| ***E05F 15/63*** | (2015.01) |
| ***E05F 15/616*** | (2015.01) |
| ***E05F 15/662*** | (2015.01) |

(52) U.S. Cl.

CPC ..... *E05F 15/63* (2015.01); *E05F 15/616* (2015.01); *E05F 15/662* (2015.01); *E05Y 2201/21* (2013.01); *E05Y 2201/72* (2013.01); *E05Y 2400/20* (2013.01); *E05Y 2900/531* (2013.01); *E05Y 2900/548* (2013.01)

(58) Field of Classification Search

CPC ..... E05F 15/63; E05F 15/616; E05F 15/662; E05Y 2201/21; E05Y 2201/72; E05Y 2400/20; E05Y 2900/531; E05Y 2900/548

USPC ..... 296/146.4, 146.8

See application file for complete search history.

(56) References Cited

U.S. PATENT DOCUMENTS

| | | | | |
|---|---|---|---|---|
| 5,913,763 | A * | 6/1999 | Beran | E05F 3/102 49/506 |
| 6,637,157 | B1 | 10/2003 | Dombrowski et al. | |
| 6,877,791 | B2 | 4/2005 | Greuel et al. | |
| 7,156,447 | B2 | 1/2007 | Watanabe | |
| 8,156,838 | B2 | 4/2012 | Batosky et al. | |
| 8,234,817 | B2 | 8/2012 | Neundorf et al. | |

(Continued)

FOREIGN PATENT DOCUMENTS

| | | |
|---|---|---|
| CN | 1280923 A | 1/2001 |
| CN | 102057123 A | 5/2011 |

(Continued)

OTHER PUBLICATIONS

Examination Report for Indian Application No. 201717009091 dated Oct. 28, 2019.

(Continued)

*Primary Examiner* — Joseph D. Pape

(74) *Attorney, Agent, or Firm* — Carlson, Gaskey & Olds, P.C.

(57) ABSTRACT

A method of actuating a door includes the steps of manually pivoting a door in a direction about a hinge to provide a manual input, detecting the manual input and energizing a motor to drive the door in the direction in response to the manual input. The manual door pivoting step includes exceeding a holding torque of a brake assembly that holds the door. The direction can be any direction for opening or closing the door.

4 Claims, 9 Drawing Sheets

(56) References Cited

U.S. PATENT DOCUMENTS

| | | | | |
|---|---|---|---|---|
| 8,262,150 | B2 | 9/2012 | Harding et al. | |
| 8,414,062 | B2 | 4/2013 | Gobart et al. | |
| 8,863,604 | B2 | 10/2014 | Muller | |
| 2004/0046401 | A1 | 3/2004 | Watanabe | |
| 2004/0256881 | A1 | 12/2004 | Takeda et al. | |
| 2009/0265992 | A1* | 10/2009 | Hass | E05F 15/63 49/340 |
| 2013/0239485 | A1 | 9/2013 | Reed et al. | |
| 2014/0150581 | A1 | 6/2014 | Scheuring et al. | |
| 2015/0240548 | A1 | 8/2015 | Bendel et al. | |

FOREIGN PATENT DOCUMENTS

| | | | |
|---|---|---|---|
| EP | 2138661 | B1 | 10/2012 |
| GB | 872577 | | 9/1958 |
| JP | 2004100309 | A | 4/2004 |
| JP | 2004338535 | A | 12/2004 |
| JP | 3735333 | B2 | 1/2006 |
| JP | 2014105486 | A | 6/2014 |
| RU | 56924 | U1 | 9/2006 |

OTHER PUBLICATIONS

International Search Report and Written Opinion for PCT/ US2015/025074 dated Dec. 10, 2015.
Japanese Office Action for JP Application No. 2017-529367 dated Aug. 6, 2018.
Korean Notification of Provisional Rejection for Korean Patent Application No. 10-2017-7015588 dated Sep. 5, 2018.
International Preliminary Report on Patentability for International Application No. PCT/US2015/025074 dated Oct. 19, 2017.
Office Action for Russian Application No. 2017121614 dated Jul. 11, 2018.
Office Action for Chinese Application No. 201580057613.1 dated Feb. 12, 2018.
Examination Report for Australian Application No. 2015390247 dated Nov. 29, 2017.

* cited by examiner

VEHICLE DOOR SYSTEM WITH POWER DRIVE MODULE

CROSS-REFERENCE TO RELATED APPLICATIONS

This application is a divisional of U.S. patent application Ser. No. 15/533,472, filed Jun. 6, 2017, which is a United States National Phase Application of PCT Application No. PCT/US2015/025074, which was filed Apr. 9, 2015.

BACKGROUND

This disclosure relates to an automated door for a vehicle, and more particularly, for a vehicle passenger door.

Increasingly power doors are being provided on vehicles, such as a rear liftgate to a cargo area of a sport utility vehicle or a sliding door on one or both sides of a minivan. A power drive module moves the liftgate or sliding door between opened and closed positions in response to an input from an electrical switch.

Typically, a passenger door is manually opened or closed by pushing or pulling on the door without the benefit of a power drive module. Passenger doors are conventionally held opened and closed using a door check. A passenger pushes a button or engages a handle which unlatches the door from the door pillar. The door check is interconnected between the frame and the door. The door check typically includes detents that define discrete door open positions, which hold the door open.

Power door modules have been applied to passenger doors, but these modules are rather complex. For example, a motor is used to selectively drive gears through a clutch, which opens and closes to couple and decouple the motor.

SUMMARY

In one exemplary embodiment, a method of actuating a door includes the steps of manually pivoting a door in a direction about a hinge to provide a manual input, detecting the manual input and energizing a motor to drive the door in the direction in response to the manual input. The manual door pivoting step includes exceeding a holding torque of a brake assembly that holds the door. The direction can be any direction for opening or closing the door.

In a further embodiment of any of the above, the detecting step includes back-driving a gearbox via an output shaft and detecting rotation of the output shaft.

In a further embodiment of any of the above, the detecting step includes back-driving the motor and detecting rotation of the motor, which is indicative of the rotation of the output shaft.

In a further embodiment of any of the above, the manual door pivoting step includes performing the step of releasing the brake assembly prior to performing the step of energizing the motor.

BRIEF DESCRIPTION OF THE DRAWINGS

The disclosure can be further understood by reference to the following detailed description when considered in connection with the accompanying drawings wherein.

Figure 1A:
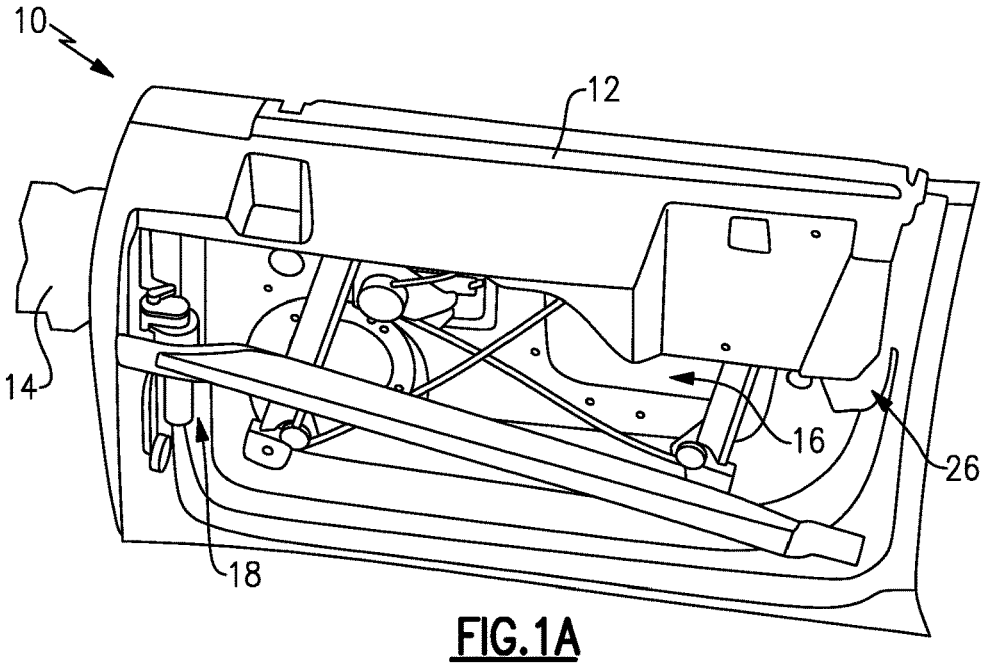
FIG. 1A is a perspective view of a vehicle door with a power drive module mounted to a door pillar.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

A conventional automotive vehicle 10 (only a portion shown) typically includes multiple doors 12 (one shown) used for egress and ingress to the vehicle passenger compartment and/or cargo area. In the example, the door 12 is a passenger door. The door 12 is pivotally mounted by hinges 15 (one shown) to a door pillar 14, such as an A-pillar or B-pillar, about which the door is movable between opened and closed positions. The door 12 has a cavity 16 that typically includes an impact intrusion beam, window regulator, and other devices. A power drive module 18 is arranged within the cavity 16, although the power drive module 18 can instead be arranged in the door pillar 14, if desired. Mounting the power drive module 18 near the hinges 15 minimizes the impact on door inertia.

The power drive module 18 is part of a door system 20 (FIG. 2) that permits automated opening and closing of the door 12 without the need of a user to manually push and pull on the passenger door, as is typical. However, the system 20 can be used as a conventional door, overriding the door check and automated opening and closing features. The system 20 may also act as a door hold, or door check, without the need of a typical door check that has discrete detents.

Figure 1B:
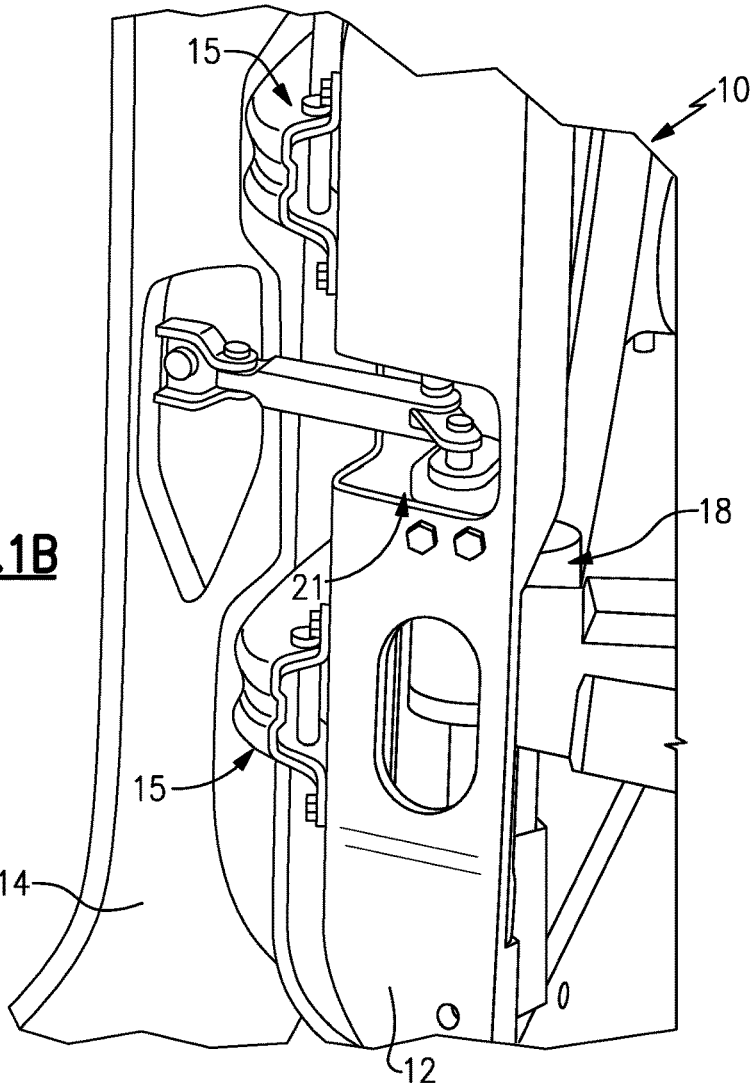
FIG. 1B is an enlarged perspective view of the door illustrating a linkage assembly of the power drive module.

Referring to FIG. 1B, the power drive module 18 is connected to the door pillar 14 by a linkage assembly 21. The linkage assembly 21 transmits the opening and closing forces provided by the power door module 18 to the door pillar 14 and also holds the door 12 open when desired.

Figure 2:
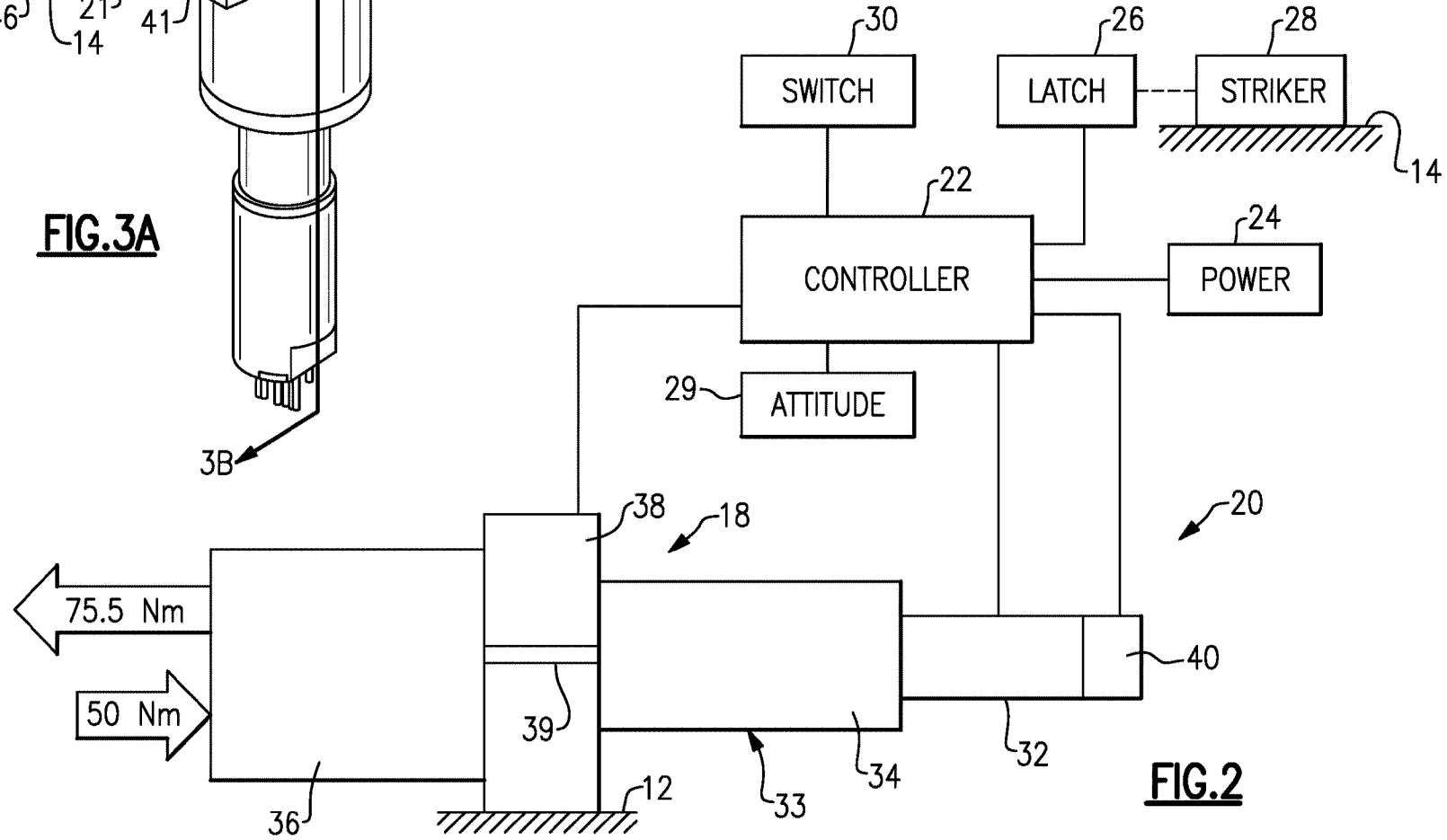
FIG. 2 is a schematic view of an example door system embodiment that uses the power drive module.

Referring to FIG. 2, the system 20 includes a controller 22, or electronic control unit (ECU), that receives inputs from various components as well as sends command signals to the power drive module 18 to open and close the door 12 in response to a user request. A power supply 24 is connected to the controller 22, which selectively provides electrical power to the power drive module 18 in the form of commands A latch 26 and a switch 30 are also in communication with the controller 22. The latch 26, which is carried by the door 12 (FIG. 1A), is selectively coupled and decoupled to a striker 28 mounted to the door pillar 14. In the example, the latch 26 is a power pull-in latch. The switch 30 provides a first input to the system 20 indicative of a user request to automatically open or close the door 12.

A vehicle attitude sensor 29 is in communication with the controller 22 and is used to detect the attitude of the vehicle, which is useful in controlling the motion of the door 12 when operated by the power drive module 18.

Figure 3A:
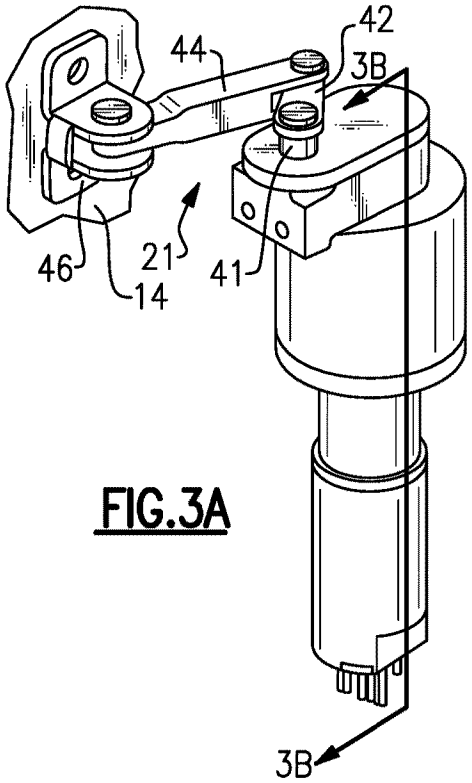
FIG. 3A is a perspective view of the power drive module.
Figure 3B:
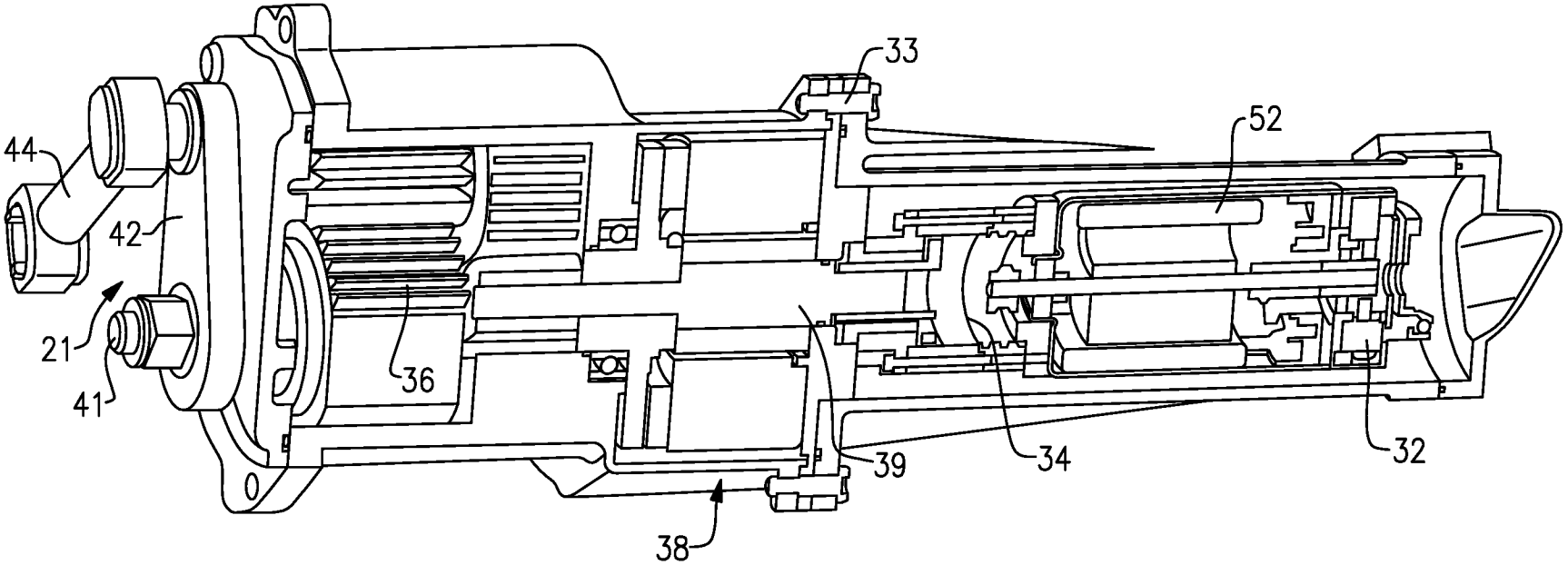
FIG. 3B is a cross-sectional view of the power drive module taken along line 3B-3B of FIG. 3A.

Referring to FIGS. 2 and 3B, the power door module 18 includes a motor 32 arranged within a housing 33. The housing 33 may be provided by one or more discrete structures secured to one another. In the example, the motor provides a relatively small amount of torque, for example, about ⅓ Nm. One example motor is available from Johnson Motor Company, Model No. 1999-1061255.

A gearbox is used to multiply the torque provided by the motor 32. In the example two gearboxes are used, although more or fewer gearboxes may be used. First and second gearboxes 34, 36 are arranged within the housing 33 and coupled to one another in series by a shaft member 39 in the example embodiment. The first gearbox 34 connects the motor 32 to the second gearbox 36. In one example, the first gearbox is a planetary gear set providing a 35:1 reduction ratio. The second gearbox 36 is a spur gear set providing a 6.25:1 reduction. Thus, the total gear ratio is 218.75:1, which in conjunction with type of gearboxes proposed, provides a fully back-drivable arrangement that does not require a clutch in the event of a desired manual operation of the door. Of course, it should be understood that other gear configurations and gear reductions may be provided.

A brake assembly 38 is positioned between the first and second gearboxes 34, 36 in the example shown, although the brake assembly 38 may be arranged in other locations. The brake assembly 38 is grounded to the door 12 via the housing 33 and is selectively connected to the shaft member 39. One suitable brake assembly is available from Sinfonia NC, Model No. ERS-260L/FMF. This brake assembly 38 provides a relatively small amount of holding torque, for example, 8 Nm. However by use of the second gearbox 36 provides a holding torque of about 50 Nm. Any torque applied to the brake assembly 38 above this threshold holding torque will cause the brake to slip, permitting the shaft member 39 to rotate.

The brake assembly 38 has a normally closed position in which the shaft member 39 is grounded to the housing 33 and prevented from rotating. The brake assembly 38 also includes an opened position corresponding to one of a door closing mode and a door opening mode. In the open position, the brake assembly 38 permits the shaft member 39 to rotate freely.

A position sensor 40, which is in communication with the controller 22, monitors the rotation of a component of the power drive module 18, for example, the motor 32. In one example, the position sensor 40 is an integrated Hall effect sensor that detects the rotation of a shaft of the motor 32.

Referring to FIG. 3A, the second gearbox 36 rotationally drives an output shaft 41 coupled to the linkage assembly 21. In one example, the output shaft provides about 75 Nm of torque. A lever 42 is mounted to the output shaft 41 at one end and to a strap 44 at the other end. The strap 44 is pinned to a bracket 46 fastened to the door pillar 14. The linkage assembly 21 is designed to provide a holding torque of approximately the same as the desired door holding moment.

Figure 4:
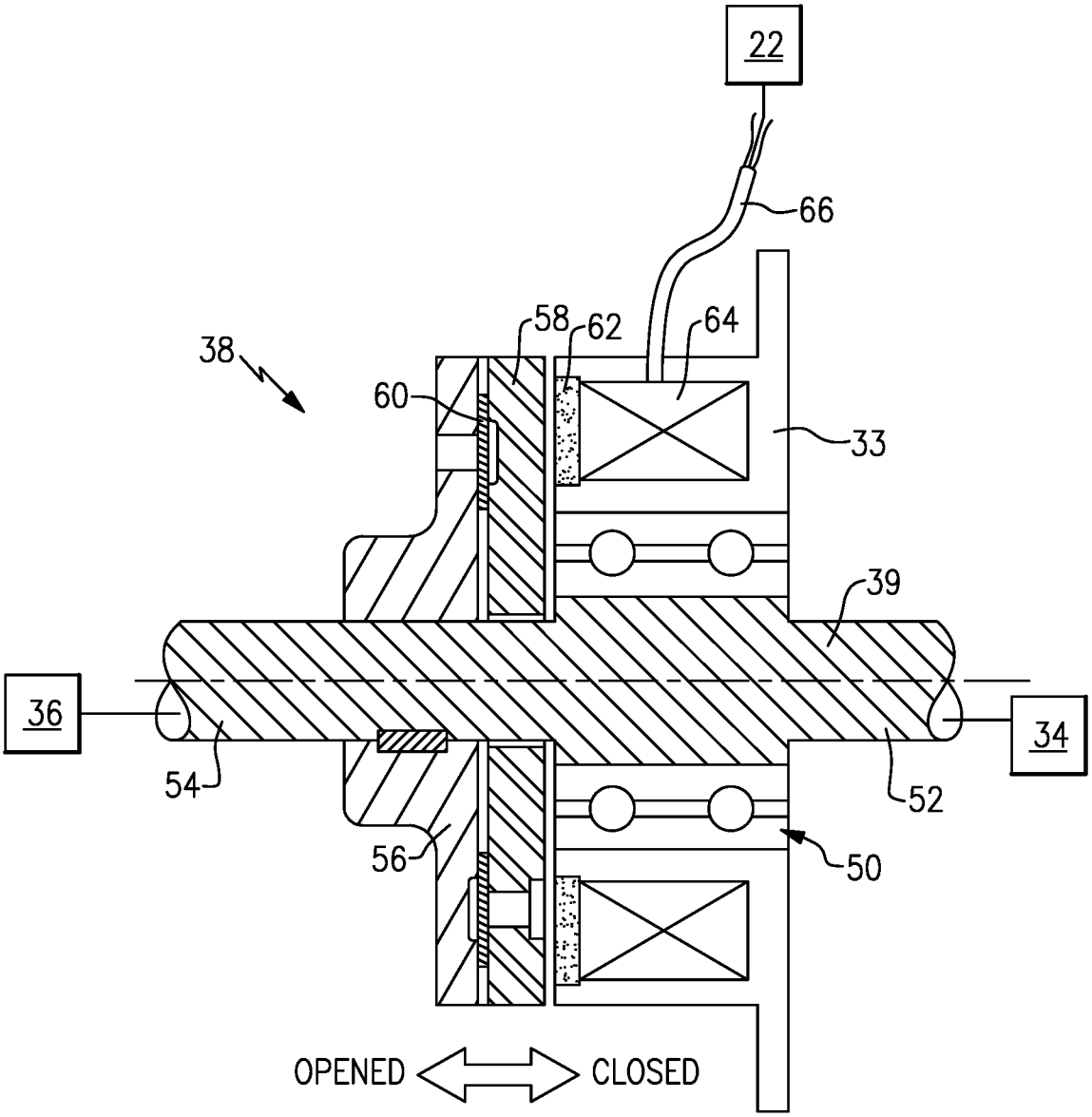
FIG. 4 is a cross-sectional view of a brake assembly for the power drive module.

One example brake assembly 38 is shown in more detail in FIG. 4. The shaft member 39 is carried by a bearing 50 mounted to the housing 33. One end 52 is connected to the first gearbox 34, and the other end 54 is connected to the second gearbox 36. A drive ring 56 is secured to the end 54 and supports a permanent magnet 58. A spring 60, which may be a leaf spring in one example, is arranged between the drive ring 56 and permanent magnet 58 to bias the permanent magnet 58 away from the housing 33. A magnetic field generated by the permanent magnet 58 pulls the drive ring 56 with a much greater force than the spring 60 toward the housing 33. Friction material 62 is supported by the housing 33 and engages the permanent magnet 58 in the normally closed position to provide the torque at which the permanent magnet 58 will slip with respect to the housing 33, again, about 8 Nm.

A magnetic flux circuit, or coil 64, is arranged within the housing 33 and communicates with the controller 22 via wires 66. When energized, the coil 64 creates a counteracting magnetic flux to the permanent magnet 58 that is sufficient to overcome the magnetic field of the permanent magnet 58, thus allowing the spring 60 to move the permanent magnet 58 out of engagement with the friction material 62 to the position shown in FIG. 4. In this opened position, the shaft member 39 is permitted to rotate freely relative to the housing 33. The brake assembly components can be reconfigured in a manner different than described above and still provide desired selective brake hold torque.

Figure 5:
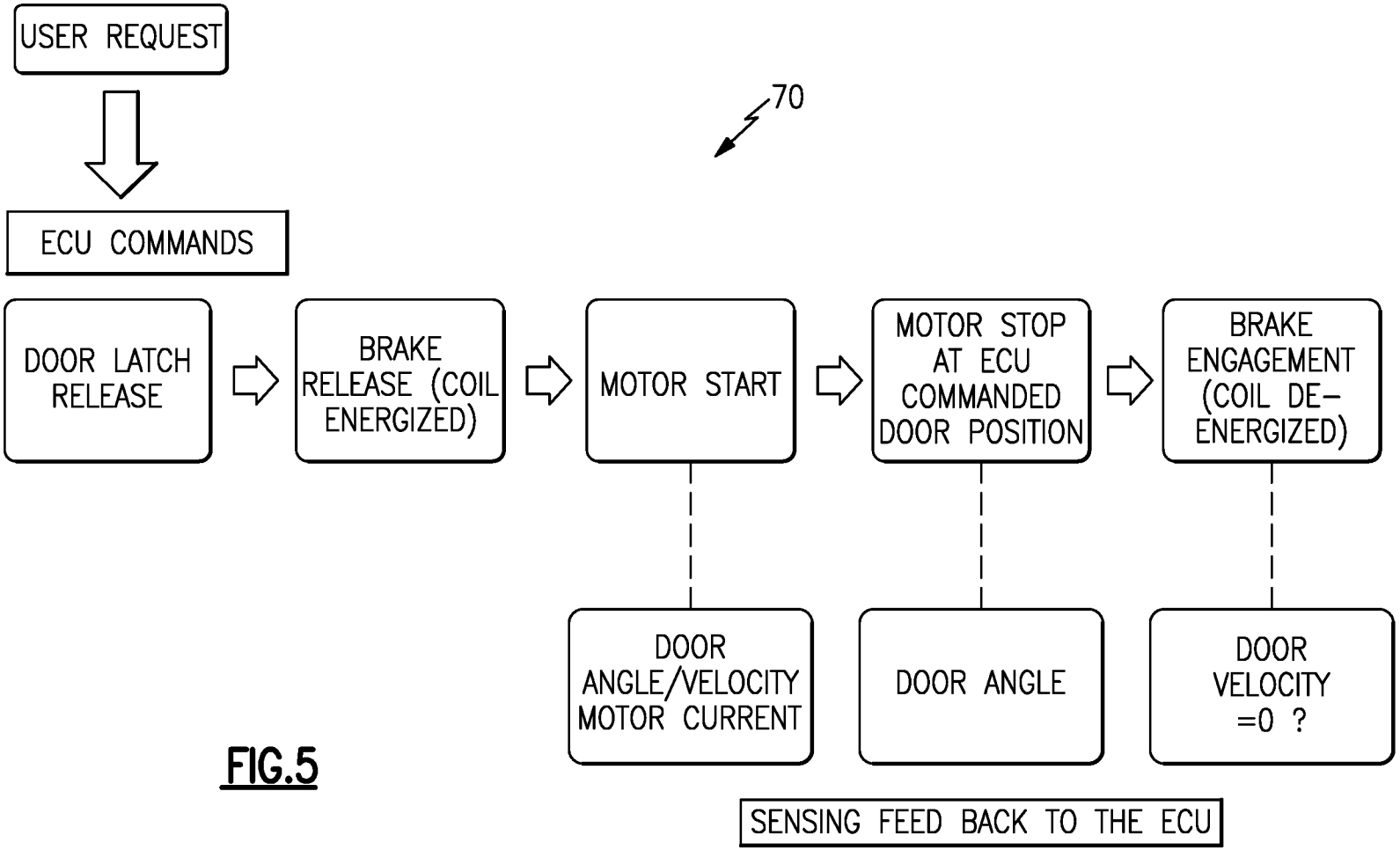
FIG. 5 is a flow chart depicting a switch commanded opening in an automated door opening mode.

One example operating mode 70 is shown in FIG. 5, with reference to FIG. 2. The controller 22 receives a first input from the switch 30, such as a user request from an integrated door handle switch, keyless entry device or other input. In response to the first input, the latch 26 is commanded to release from the striker 28. The coil 64 (FIG. 4) is energized to move the permanent magnet 58 to the opened position. The motor 32 rotationally drives the first gearbox 34 and the second gearbox 36 via the shaft member 39, which rotates freely relative to the housing 33. The position sensor 40 detects the angular position of the door 12 as well as door velocity.

The linkage assembly 21 swings the door 12 open to a limit position and the motor 32 is stopped by the controller using the position sensor 40. The coil 64 is de-energized to reengage the brake assembly 38.

With the brake assembly 38 in the normally closed position, a holding torque is generated to maintain the door 12 in its current position. In the absence of slippage in the brake assembly 38, the door velocity is detected as zero via the position sensor 40.

Figure 6:
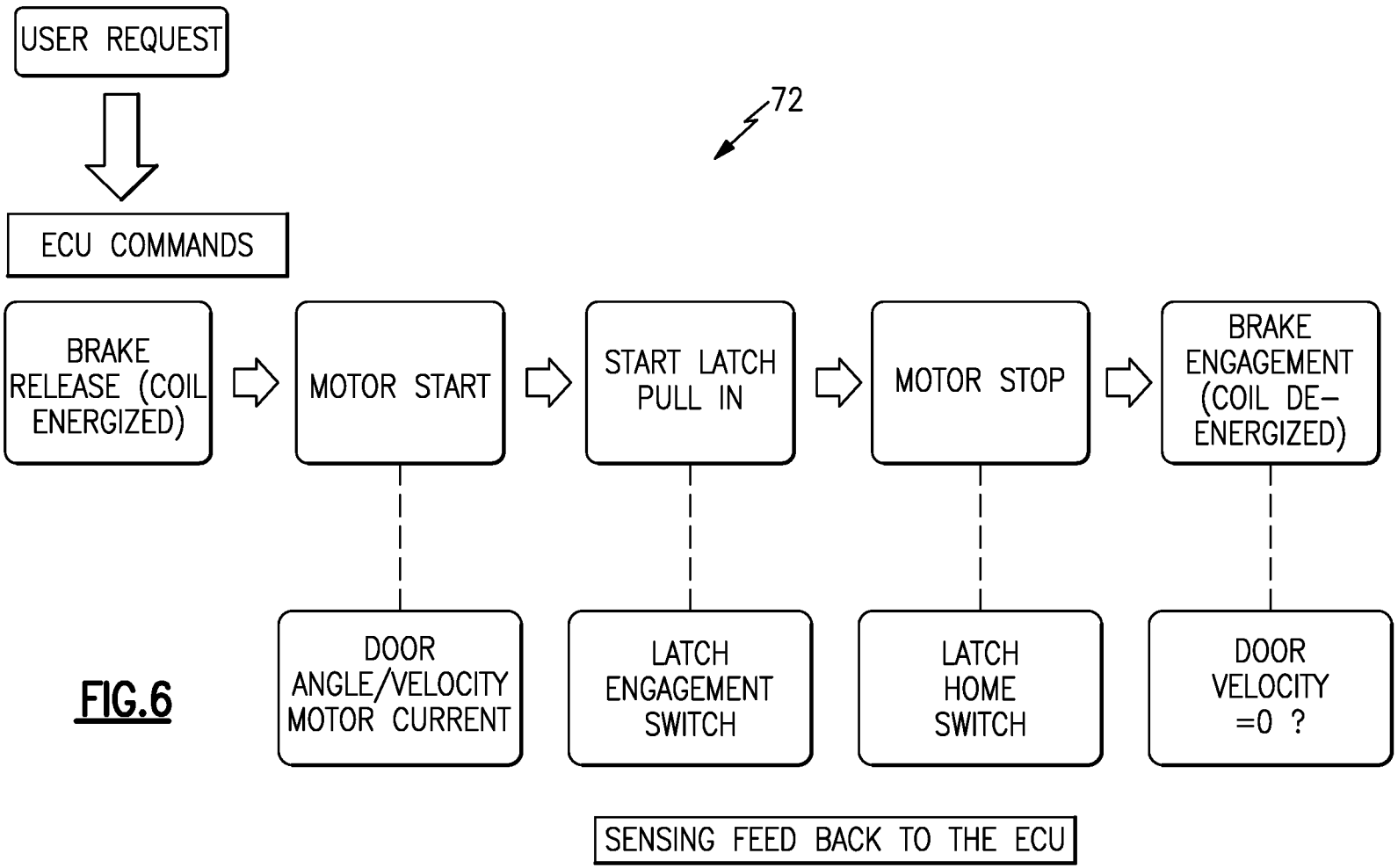
FIG. 6 is a flow chart depicting a switch commanded closing in an automated door closing mode.

The automated door closing mode 72 is generally the reverse of the automated door opening mode and is shown schematically in FIG. 6. The controller 22 energizes the coil 64 in response to a first input from the switch 30 to move the permanent magnet 58 to the opened position. The motor 32 rotationally drives the first gearbox 34 and the second gearbox 36 via the shaft member 39, which rotates freely relative to the housing 33. The position sensor 40 detects the angular position of the door 12 as well as door velocity.

The linkage assembly 21 swings the door 12 closed to a limit position, which corresponds to the closed position in which the striker 28 is received in the power pull-in latch 26. The latch 26 is commanded to pull the striker 28 in to fully close and seal the door 12 relative to the door opening. A latch "home" position is detected by the controller 22, for example, with a sensor in the latch 26, and the motor 32 is stopped. The coil 64 is de-energized to reengage the brake assembly 38, and the door velocity is detected as zero via the position sensor 40.

In addition to the automated opening and closing modes using a switch, the door may be opened and closed in a power manual mode by the user pushing or pulling on the door.

Figure 7:
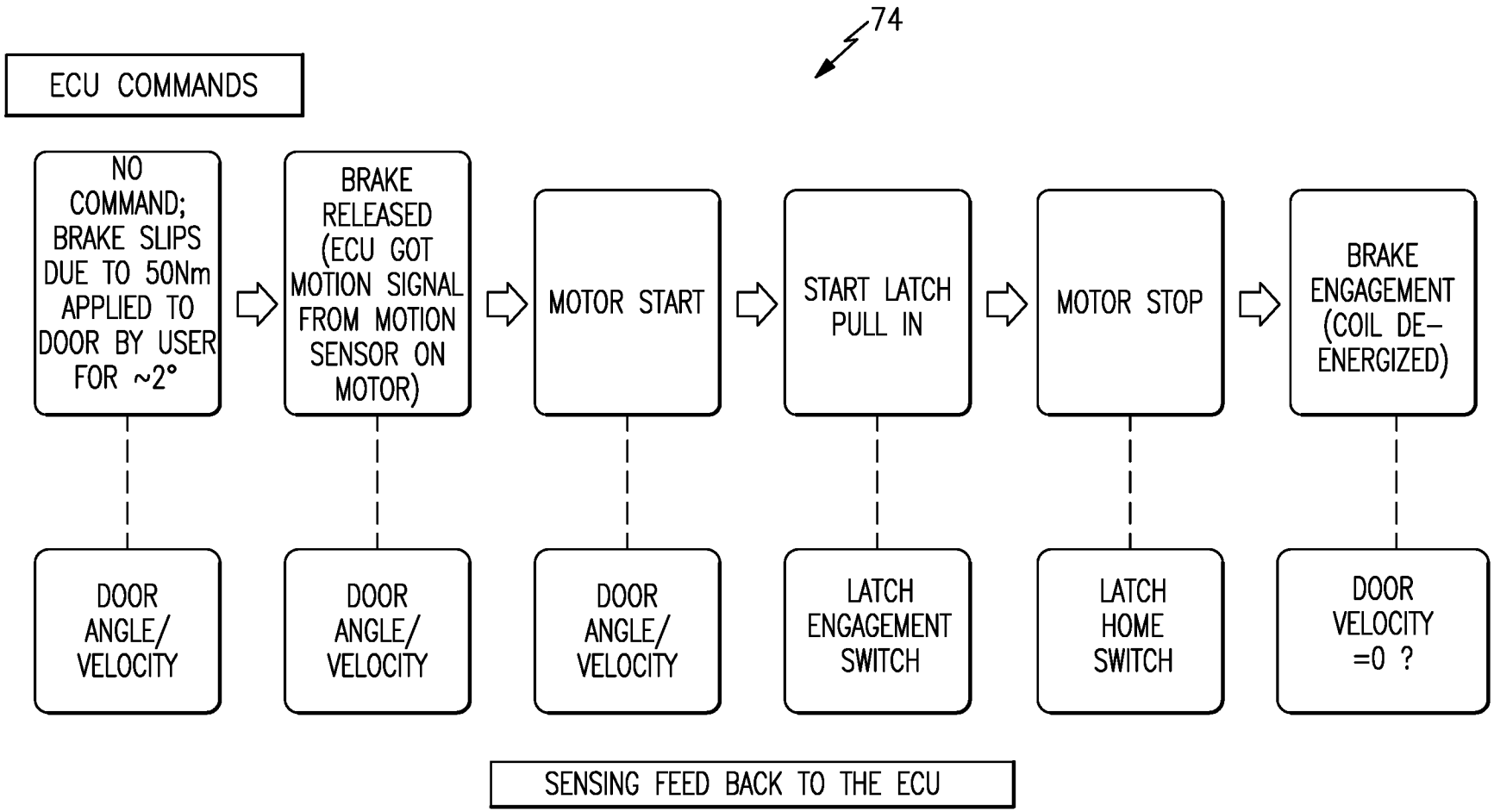
FIG. 7 is a flow chart depicting a push/pull door commanded closing in a power manual opening mode.

A power manual closing mode 74 is shown in FIG. 7. Unlike the automated closing mode (FIG. 6), no first input is received from the switch 30. Instead, with the door 12 already at least partially open, the door 12 is pushed or pulled closed by the user, which causes the linkage assembly 21 to rotate the output shaft 41 and back-drive second gearbox 36 and shaft member 39. When enough torque has been applied to slip the brake torque of the normally closed brake assembly 38 (in the example, 50 Nm), the shaft member 39 will rotate and back-drive the motor 32 via the first gearbox 34. An angular movement of the output shaft 41 is detected by the position sensor 40, which detects rotation of the motor 32 that is indicative of rotation of the output shaft 41.

A detected threshold angular movement, for example, 2°, provides a second input and is interpreted as a desired closing command by the controller 22. Of course, other angular thresholds can be used, if desired. The resolution of the position sensor 40 does not have to be particularly high, as small angular movements of the shaft member 39 are multiplied by the first and second gearbox 34.

Thus, in response to the second input from the position sensor 40 (and in the absence of a first input), the controller will command the motor 32 to rotationally drive the first gearbox 34 and the second gearbox 36 via the shaft member 39, which rotates freely relative to the housing 33 in the desired closing direction. Again, the position sensor 40 is used to detect the angular position of the door 12 as well as door velocity.

The linkage assembly 21 swings the door 12 closed to a limit position, which corresponds to the closed position in which the striker 28 is received in the power pull-in latch 26. The latch 26 is commanded to pull the striker 28 in to fully close and seal the door 12 relative to the door opening. A latch "home" position is detected by the controller 22, for example, with a sensor in the latch 26, and the motor 32 is stopped. The coil 64 is de-energized to reengage the brake assembly 38, and the door velocity is detected as zero via the position sensor 40.

Figure 8:
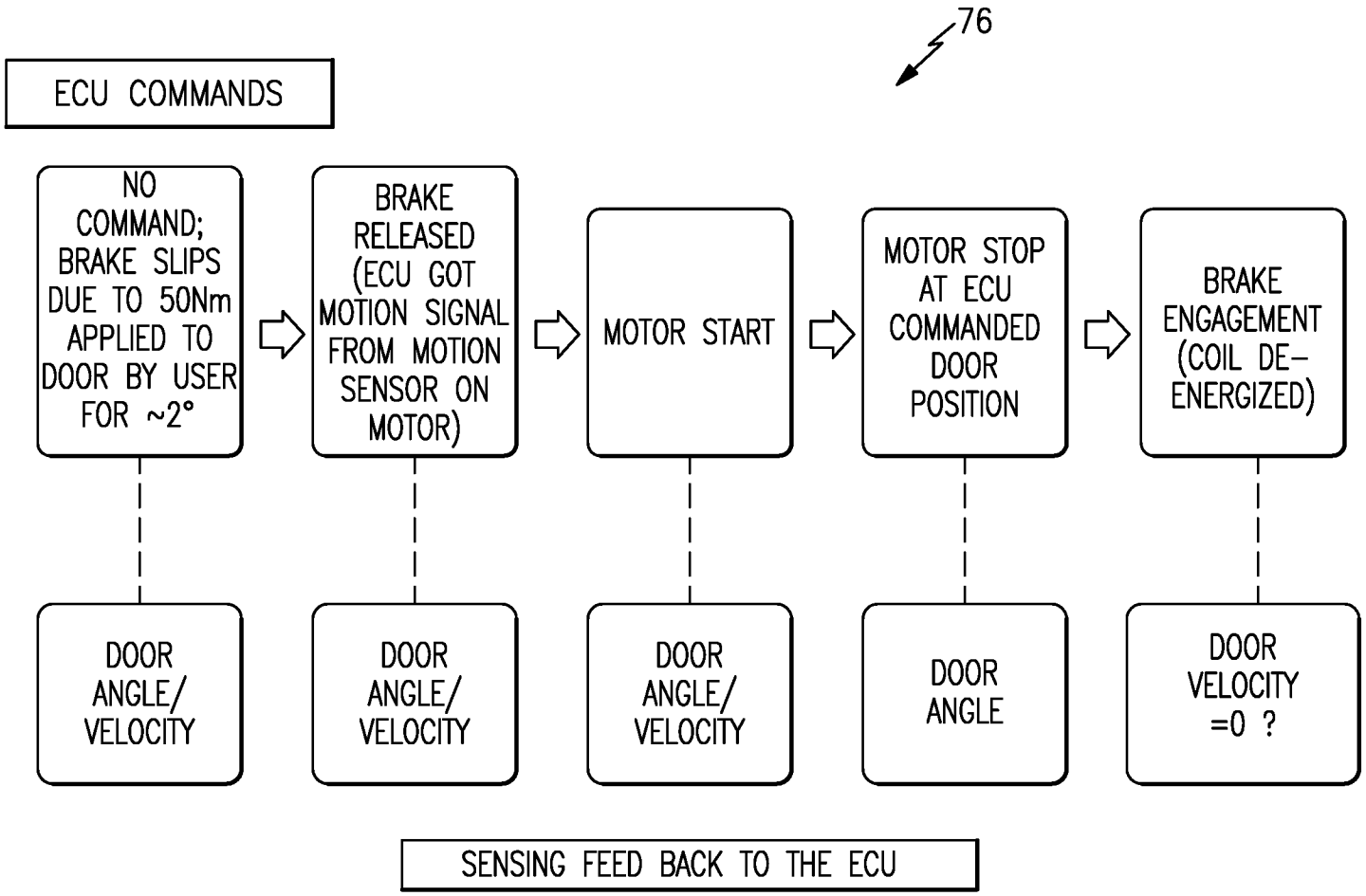
FIG. 8 is a flow chart depicting a push/pull door commanded opening in a power manual closing mode.

A power manual opening mode 76 is shown in FIG. 8. Unlike the automated opening mode (FIG. 5), no first input is received from the switch 30. Instead, with the door 12 already at least partially open, the door 12 is pushed or pulled open by the user, which causes the linkage assembly 21 to back-drive second gearbox 36 and shaft member 39. When enough torque has been applied to slip the brake torque of the normally closed brake assembly 38 (in the example, 50 Nm), the shaft member 39 will rotate and back-drive the motor 32 via the first gearbox 34. The angular movement is detected by the position sensor 40.

The threshold angular movement of 2° provides a second input and is interpreted as a desired opening command by the controller 22 based upon the direction of rotation detected. Thus, in response to the second input from the position sensor 40 (and in the absence of a first input), the controller 22 will command the motor 32 to rotationally drive the first gearbox 34 and the second gearbox 36 via the shaft member 39, which rotates freely relative to the housing 33. The position sensor 40 is used to detect the angular position of the door 12 as well as door velocity.

The linkage assembly 21 swings the door 12 open to a limit position, and the motor 32 is stopped by the controller using the position sensor 40. The coil 64 is de-energized to reengage the brake assembly 38.

With the brake assembly 38 in the normally closed position, a holding torque is generated to maintain the door 12 in the open position. In the absence of slippage in the brake assembly 38, the door velocity is detected as zero via the position sensor 40.

The automated door opening and closing modes and power manual opening and closing modes were described as door motion to either the fully open or fully closed door positions. However, the door 12 may also be moved between discrete positions that are not either fully open or closed. For example, if the user pushes or pulls on an open door when fully open, the power manual closing mode will begin to close the door 12. The user may then hold the door 12, preventing further movement of the door 12, which will be detected by the position sensor 40 and change the current in the motor 32. The controller 22 then command the motor 32 to stop and de-energize the brake assembly 38, which will hold the door 12 where the user stopped the door 12.

The holding torque decay of the brake assembly 38 can be adjusted with pulse-width modulation of the coil 64. In one example, the vehicle attitude is detected with the attitude sensor 29 to vary the holding torque provided by the brake assembly 38 to provide a consistent holding torque regardless of vehicle incline or decline, which creates predictable door motion for the user. For example, a greater holding torque would be applied by the brake assembly 38 when the vehicle is on an incline than when the vehicle is on level ground.

Figure 9A:
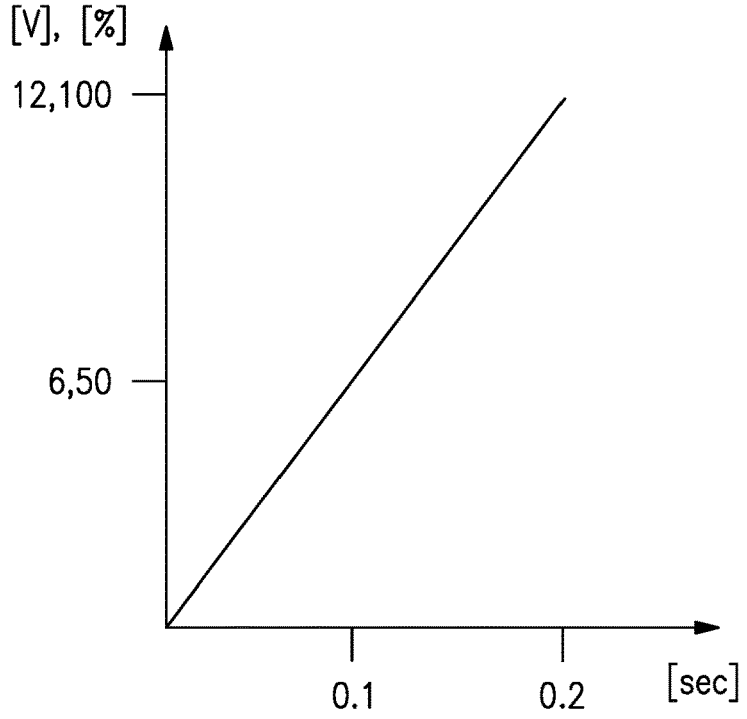
FIG. 9A is a graph illustrating brake assembly voltage versus time.
Figure 9B:
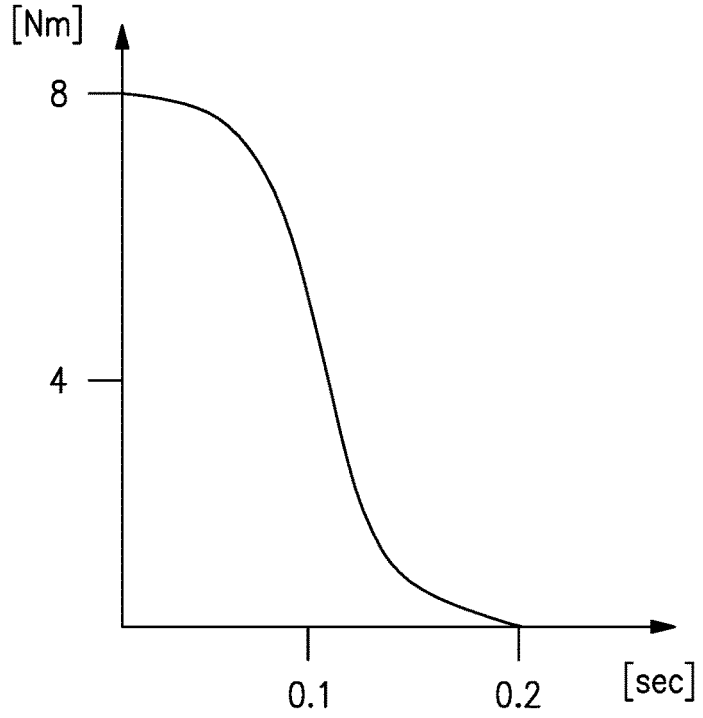
FIG. 9B is a graph illustrating brake assembly holding torque versus time according to the voltage-time relationship shown in FIG. 9A.

In a second example it may be desirable to "soft" release the brake assembly 38 to prevent an abrupt door movement that may cause an undesirable door feel for the customer. For example, 50 Nm of holding torque may produce a force in the linkage assembly 21 at the door pillar 14 of 700-900 N, which is capable of producing an audible sheet metal popping sound due to the sudden release of the stored hold moment energy. To address this potential undesired scenario, a soft release function is used, as shown in FIG. 9A, to ramp the pulse-width modulation signal from the controller 22 over, for example, 0.2 seconds, to full strength. As a result, the electrical counter field to the permanent magnetic field is slowly increased, thus reducing the brake hold torque from full strength to released, as shown in FIG. 9B, over the 0.2 seconds, which provides a "soft" release of the brake action. In the example, a gradual, linear increase in voltage provides a smooth, non-linear decay of holding torque. However, it should be understood that other voltage-torque-time relationships may be provided electrically and/or mechanically to provide a desired door feel.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A method of actuating a door comprising the steps of:

manually pivoting a door in an opening or closing direction about a hinge to provide a manual input;

detecting the manual input; and energizing a motor to drive the door in the direction in response to the manual input, wherein the manual door pivoting step includes exceeding a holding torque of a brake assembly that holds the door, wherein the direction can be any direction for opening or closing the door.

2. The method according to claim 1, wherein the detecting step includes back-driving a gearbox via an output shaft and detecting rotation of the output shaft.

3. The method according to claim 2, wherein the detecting step includes back-driving the motor and detecting rotation of the motor, which is indicative of rotation of the output shaft.

4. The method according to claim 1, wherein the manual door pivoting step includes performing the step of releasing the brake assembly prior to performing the step of energizing the motor.

* * * * *